US006773383B2

(12) United States Patent
Bschorr et al.

(10) Patent No.: US 6,773,383 B2
(45) Date of Patent: Aug. 10, 2004

(54) VIBRATION DAMPING ROLL

(75) Inventors: Oskar Bschorr, Munich (DE); Hans-Joachim Raida, Cologne (DE)

(73) Assignee: Dofasco Inc., Hamilton (CA)

( * ) Notice: Subject to any disclaimer, the term of this patent is extended or adjusted under 35 U.S.C. 154(b) by 0 days.

(21) Appl. No.: 09/982,806

(22) Filed: Oct. 22, 2001

(65) Prior Publication Data

US 2002/0072457 A1 Jun. 13, 2002

Related U.S. Application Data

(63) Continuation-in-part of application No. PCT/DE00/01240, filed on Apr. 20, 2000.

(30) Foreign Application Priority Data

Apr. 23, 1999 (DE) ..... 199 18 555

(51) Int. Cl.[7] ..... B23D 15/00
(52) U.S. Cl. ..... 492/2; 492/1; 492/3; 492/15
(58) Field of Search ..... 492/54, 1, 2, 3, 492/15, 38, 43, 53; 72/199, 224, 225, 226, 237, 365.2, 366.2

(56) References Cited

U.S. PATENT DOCUMENTS

| | | | | |
|---|---|---|---|---|
| 620,286 A | | 2/1899 | Dodge | |
| 1,790,697 A | | 2/1931 | Capito | |
| 3,111,894 A | | 11/1963 | Murray | |
| 3,279,234 A | | 10/1966 | Ames | |
| 3,503,242 A | | 3/1970 | Polakowski | |
| 4,842,944 A | | 6/1989 | Kuge et al. | |
| 5,081,760 A | | 1/1992 | Kikuhara et al. | |
| 5,380,264 A | | 1/1995 | Ookouchi et al. | |
| 5,393,290 A | | 2/1995 | Lehmann et al. | |
| 5,609,554 A | * | 3/1997 | Hayashi et al. | 492/56 |
| 5,934,130 A | | 8/1999 | Kajiwara et al. | |

FOREIGN PATENT DOCUMENTS

| | | | |
|---|---|---|---|
| DD | 204 631 | | 12/1983 |
| DE | 24 12 672 | | 9/1975 |
| DE | 24 49 874 | | 4/1976 |
| DE | 2449874 | * | 4/1976 |
| DE | 31 13 268 | | 10/1982 |
| DE | 41 03 248 A1 | | 8/1992 |
| DE | 4103248 | * | 8/1992 |
| EP | 0 855 233 A1 | | 7/1998 |
| EP | 0855233 | * | 7/1998 |
| GB | 1026207 | | 4/1966 |
| JP | 61-18658 | * | 1/1986 |
| JP | 61-18658 | | 4/1994 |
| JP | 7-96308 | * | 4/1995 |

* cited by examiner

*Primary Examiner*—I Cuda Rosenbaum
(74) *Attorney, Agent, or Firm*—Ingrid E. Schmidt

(57) ABSTRACT

A vibration damping roll is provided for rolling contact with a vibrating structure. The vibration damping roll incorporates a wave guide consisting of radially alternating rigid and flexible material having at least two rigid elements disposed adjacent to flexible material and may be provided in the form of a layered structure, a spiral structure, or a plurality of discrete rigid elements disposed in a matrix of flexible material.

18 Claims, 6 Drawing Sheets

$$M_n\ddot{x}_n + (D_n + R_n + E_n)\dot{x} + C_n x_n = F_{on}$$

VIBRATION DAMPING ROLL

CROSS REFERENCE TO RELATED APPLICATION

This application is a continuation-in-part of PCT International Application Number PCT/DE00/01240 filed on Apr. 20, 2000.

FIELD OF THE INVENTION

This invention relates to reducing chatter which occurs e.g. during cold-rolling of steel sheets/plates. Under unfavourable operating conditions, periodic oscillations appear in addition to base oscillations and they grow exponentially. The rolled product thereby suffers from a reduction in quality. This leads to rejects and also to damage to the rolling mill. Also with low chatter instability, so called thickness and/or surface waves occur. The same chatter phenomena also occur in the manufacture of many products other than steel including paper; tapes or wires.

BACKGROUND OF THE INVENTION

When exceeding a certain oscillation amplitude, a rolling parameter is changed—usually the rolling speed is reduced—in order to get out of the critical operation range. Such a process is not satisfactory, since it does not eliminate the primary cause.

In GB-A-1036922 it is suggested to avoid roll oscillations by using a roll shaped oscillation absorber, which has a thin, hard outer layer (e.g. steel) and thereunder a softer, oscillation damping layer (e.g. rubber), the rest of the roll body being a solid body. The soft damping layer provides a decoupling of oscillations. However, the damping achieved with this arrangement is low. In U.S. Pat. No. 3,111,894 it is described how the oscillation behaviour of a rolling mill is influenced by the contact pressure of rolls, i.e. the eigenfrequencies are shifted. Moreover, a roll is described that has an outer rubber layer and should thereby be able to damp the oscillations of rolls that are coupled to it. As already mentioned above, a rubber layer primarily provides an oscillation decoupling. The damping effect of such a measure is low.

SUMMARY OF THE INVENTION

The problem underlying the invention is to introduce, a priori, an inhibitor of self-excited oscillations in rolling processes. This problem is solved by incorporating wave guides into a roll. The location is determined by the motions within the mode shapes that tend to feed back resonance oscillations. Technical executions of the wave guides are oscillation absorbers, as e.g. described in "VDI-Richtlinie 2737, Blatt 1. (1980)" [Guideline N°2737 of the Association of German Engineers, sheet 1. (1980)], and resonance dampers. Oscillation absorbers have a spectrally adjustable resistance. Wave guides that are effective for several transitional and rotational degrees of freedom are of advantage. Suitable for this invention are oscillation absorbers of a layered construction type, as known per se from DE-A-2412672 and DE-A-3113268 the disclosures of which are herein incorporated by reference. Resonance dampers, on the other hand, are only effective at their resonance frequency and they can only be used where the chatter frequency is exactly known and constant. By incorporating the wave guide into a roll, the resistance of the wave guide can be very closely and rigidly coupled to the locations in which the rolling energy is transformed into work of deformation, to reduce instability by introducing rolling forces and rolling moments with a degressive force characteristic.

BRIEF DESCRIPTION OF THE DRAWINGS

Preferred embodiments of the invention will be described below with reference to the accompanying drawings, in which.

The following designations are agreed upon for the description (X=Number of the Figure):

X0=rolling mill, rolling stand;
X1,X2=rolls;
X3=rolled product;
X4=vibration damping roll; resistance body, resistance generator.
X5=mechanical waveguide
X6=axle assembly
X7=hub
X8=outer shell
X9=bearing
X00=rigid element or layer
X02=flexible element or layer

DETAILED DESCRIPTION WITH REFERENCE TO THE DRAWINGS

Figure 1:
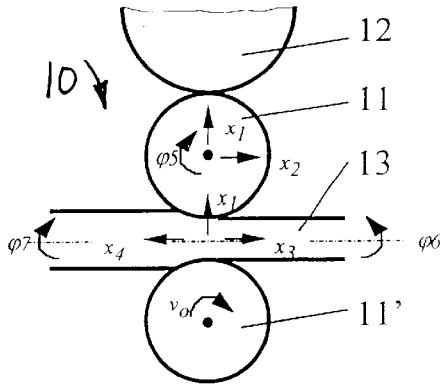
FIG. 1 is a schematic side elevation of a rolling mill.
Figure 4:
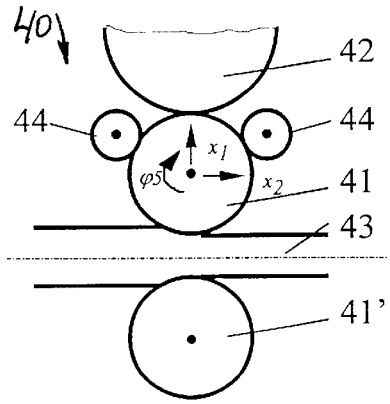
FIG. 4 is a schematic side elevation of a rolling mill incorporating a pair of vibration damping rolls according to the invention.

FIG. 1 shows a typical rolling mill 10 in which the rolled product 13 is rolled from a thickness $h_{in}$ to $h_{out}$ by the amount h, $h=h_{in}-h_{out}$, between two working rolls 11 (and 11"), supported by two back-up rolls 12 only one of which is shown. The vertical forces and deflections occurring at the working roll are $F_1$ and $x_1$, in the horizontal direction $F_2$ and $x_2$, and the moments and angle of rotation are $T_5$ and $\phi_5$. The forces and deflections (deflection velocity) on the incoming product are $F_4$ and $x_4$ ($\dot{X}_4$) and on the out-going product $F_3$ and $x_3$ ($\dot{X}_3$). In the general case, the moments and angles of rotation $T_6$, $\phi_6$ and $T_7$, $\phi_7$ also occur in immediate proximity of the rolling location. According to the well known theory of modal analysis, the rolling mill 10 can be reduced by oscillation analysis to separate modes n, which consist of the modal mass $M_n$, the modal damping $D_n$ and the modal spring $C_n$. According to FIG. 2, each mode n forms a closed, one-dimensional oscillator. The same equivalent diagram is logically valid for rotational modes with the angles of rotation $\phi$. Important for the stability of the modal oscillation is the magnitude and the sign of the differential excitation $E_n=dF_n/d\dot{X}_n$. ($\dot{X}_n=dx_n/dt$=velocity, $\ddot{X}$=acceleration). If the sign is positive, E works as a resistance and damps, if the sign is negative, E works as an oscillation exciter. If natural damping dominates, i.e. D+E>0, it is a stable oscillation system with an exponentially decreasing oscillation x. If a negative excitation factor E dominates, i.e. D+E<0, the oscillation exponentially increases. This self-excitation causes a chatter effect in the uncoupled, one-dimensional modal oscillators. Self-excited chatter oscillations can also occur with the coupling of two modes n and m with the excitation factor $E_{mn}=dF_m/d\dot{X}_n$. FIG. 4 shows an output equation for such a case.

In accordance with the problem and the solution, only the dynamic oscillation forces F and displacements x are of interest here. (The moments and angles of rotation are included therein). Constant values, as the rolling force $F(_{h0})$ and the target rolling velocity $v_0$ are transformed away when setting up the modal equivalent diagrams of FIG. 2. Also the disturbing forces resulting from non-linearities and their associated self-excited oscillations need not be considered here. The relevant problem is here the self-excited oscillation, i.e. the question whether the single oscillation modes are stable and what the resistance R of the resistance generator must be, so that the total value D+E+R>0, is consequently positive.

Figure 2:
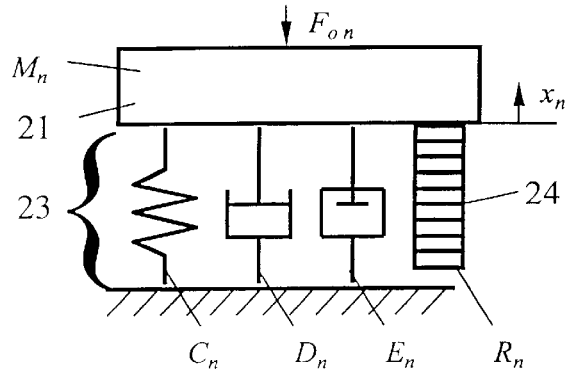
FIG. 2 is a schematic diagram of a modal equivalent system.
Figure 3:
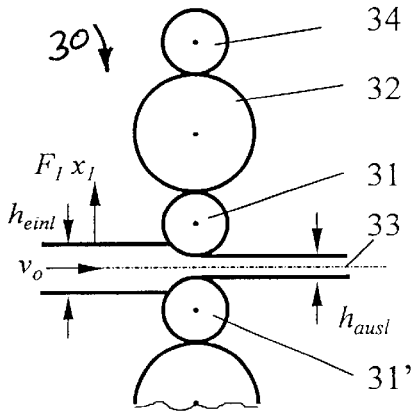
FIG. 3 is a schematic side elevation of a rolling mill incorporating a vibration damping roll according to the invention.

FIG. 3 shows a rolling stand 30, consisting of working rolls 31 (and 31') and back-up roll 32, and the rolled product 33. In order to avoid self-excited oscillations in the vertical $x_1$-direction, a vibration damping roll 34 is coupled to the back-up roll 32 and co-rotates due to the contact pressure. Its axis of rotation is parallel to the other axes and lies in the centre plane. The vibration damping roll 34 includes a mechanical wave guide as will be described further below, and has in the $x_1$-direction a spectral resistance, which is equal to R at the critical chatter frequency. FIG. 2 is used as an equivalent diagram with regard to example oscillations, especially for n=1. Because the working roll 31 and the back-up roll 32 are effectively rigidly coupled along their contact line, they oscillate in-phase in the lower frequency range, so that in this mode the sum of the masses of the rolls 31 and 32 can be retained as the modal mass $M_1$. The relevant spring constant $C_1=dF_1/dx_1$ is determined by the tapering of the rolled product: If a rolling force F(h) is necessary in order to achieve a thickness reduction of the strip of $h=h_{in}-h_{out}$ with the rolling parameter $v=v_0$ (v=rolling velocity) and h=h0, then $C_1=2dF(h)/dh$. It is here assumed that there is symmetry of the rolls above and below the rolled product 33, therefore the factor 2. The magnitude of the spring constant can also be estimated on the basis of $C_1=2F(h)/h$; this value $C_1$ corresponds to the average spring stiffness. The plastic deformation of the rolled product around h by a force F(h) can only be described as resilient spring system, because the rolled product is constantly moved along with the velocity v. (This description is not applicable for a standing roll with v=0). The natural internal friction losses are included in the damping $D_1$, which can be determined by reverberation measurements at the stationary rolling stand 30. The critical parameter for the oscillation stability is the excitation term $E_1=dF_1/d\dot{X}_1$; especially for a negative value—for a degressive rolling force characteristic—there is a danger of triggering oscillations. The governing oscillation equation for the mode n=1 is given by:

$$M_n\ddot{X}_n+(D_n+R_n+E_n)\dot{x}+C_nx_n=F_{(ho)}$$

Integration gives an $x_1$-oscillation with the angular frequency $w_{10}$ and the exponential factor exp $(-hw_{10}t)$. The static deformation due to the constant rolling load F(h0) is neglected here.

$$X_1 = x_{10}\exp(-\eta\omega_{10}t)\sin(\omega_{10}t) \text{ with}$$

$$\omega_{10} = \sqrt{\frac{C_1}{M_1}} \text{ and } \eta = (D_1 + R_1 + E_1)/\omega_{10}M_1$$

The sign of the loss factor h determines the stability of the oscillation. For a positive value, the oscillation amplitude decreases due to the damping. A negative value leads to a (theoretically exponential) increase of a resonant oscillation with the angular frequency $w_{10}$ and to a periodically changing rolling force $F_1$. The latter results in chatter with associated periodic variations of the rolled product thickness (thickness waves). By connection of the resistance R=R1 due to the resistance roll 34 it is possible to avoid self-excitation:

$$D_1 + R_1 + E_1 = \begin{cases} > 0 & \text{Damping, vibrational stability} \\ < 0 & \text{Self-excitation} \end{cases}$$

FIGS. 4 to 7 show different roll configurations to achieve damping with a resistance R, depending on the special installation conditions and on the position of the oscillation modes n tending to self-excitation. In FIG. 4 a rolling stand 40 consists again of a working and back-up roll 41 and 42 and the rolled product 43. Similar to FIG. 3, the resistance is applied here by two vibration damping rolls 44 acting onto the working roll 41. This arrangement introduces damping forces in the vertical $x_1$-direction, and the horizontal $x_2$-direction and also damping of the rotational oscillation $\phi_5$. In the latter case the vibration damping roll 44 is also designed for rotational oscillations and has the rotational resistance $R_5$. For an anti-symmetric rotational oscillation—if the two working rolls 41 and 41' oscillate in opposite directions—the moment of inertia $\phi_5$ is the sum of the working roll 41 and the back-up roll 42. The term $C_5=dT_5/d\phi_5$ acts as rotational spring for given operation conditions, characterised by index $(\ )_0$, by the rolling velocity $v_0$, the rolling force F(h0), the thickness reduction $h_0$ and the work momentum $T_{50}$. The oscillation system is stable if, in analogy to FIG. 3, natural self-damping $D_5$ and added resistance $R_5$ compensate the excitation term $E_5=dT_5/d\phi_5$. However, without the use of the vibration damping roll 44 a triggering of oscillations occurs, and the assumed anti-symmetric oscillation mode results in chatter. The multi-dimensional resistance effect according to FIG. 4 can also avoid self-excitation of two coupled modes n and m (the classical example of a mutual excitation of two modes is the flutter of the wings of a plane). The governing equation for the coupling of two modes is:

$$M_n\ddot{x}_n+(D_n+R_n)\dot{x}+C_nx_n=(dF_m/dx_n)x_n$$

$$M_m\ddot{x}_m+(D_m+R_m)\dot{x}+C_mx_m=(dF_n/dx_m)x_m$$

The left hand side of the equations describes the one-dimensional resonance oscillator of the $n^{th}$ and $m^{th}$ mode. Significant for the oscillation coupling and for the oscillation stability are the excitation terms $E_{mn}=dF_m/dx_n$ on the right hand side. In the general case chatter marks with combined thickness and surface waves are to be expected if there is self-excitation.

Figure 5:
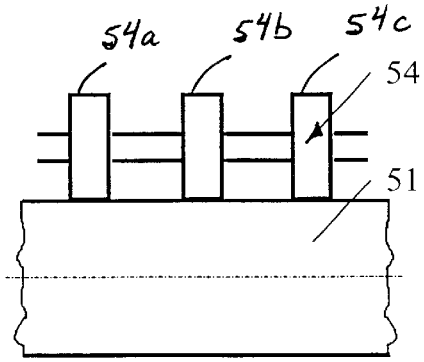
FIG. 5 is a schematic side elevation of a machine roll associated with a vibration damping roll in accordance with the invention.

In FIG. 5 a vibration damping roll 54 acting on a roll 51 consists of a number of longitudinally spaced wave guides 54*a*, 54*b*, 54*c*. Because of the bigger mass and the greater freedom of design, higher resistance densities can be achieved with resonance, so that a continuous cylinder vibration damping roll is not required and single disc-shaped rolls are sufficient. To ensure an effective dynamic coupling of the vibration damping rolls 54*a, b, c* to the roll 51, the contact line must have a high Hertzian spring constant. This is achieved if the outer steel envelope of the vibration damping roll 54 consists of steel too. If the vibration damping roll 54 is designed as a resonator, then it may be suitable to dimension the spring constant of the Hertzian contact-line so that the Hertzian spring constant and the roll mass result in a resonator with the required resonant frequency. The advantage of this solution is that the Hertzian spring constant and consequently the resonant frequency can be simply adjusted through a contact pressure force.

Figure 6:
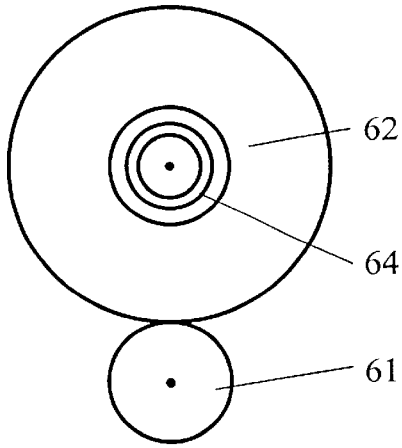
FIG. 6 is a schematic side elevation of a vibration damping roll according to the invention incorporated into a back-up roll associated with a work roll.

In FIG. 6 a wave guide 64 is incorporated into a back-up roll 62.

Within the rolled product as such, self excited oscillations can occur too. A negative excitation factor $E_3=dF_3/d\dot{X}_3$ (designation according to FIG. 1) can excite a longitudinal resonance in the moving rolled product, respectively a factor $E_5=dT_5/d\phi_5$ can excite a bending wave resonance. There is also the effect of mode excitation: if v is the roll velocity and c the wave velocity of the rolled product, then the modal excitation factor is $\mu=(v/c)^2$. The latter can be considered as "negative damping", i.e. as oscillation generator (see also: Kritische Schwingungskonzentrationen in komplexen Strukturen, Zeitschrift für Lärmbekämpfung. 45. Jg. März 1998. Springer-Verlag) [Critical oscillation concentrations in complex structures, Journal for Noise Control. $45^{th}$ year March 1998. Springer]. To exclude these oscillation instabilities, a vibration damping roll 74 with a resistance R acts on the rolled product 73 in FIG. 7. The working principle is identical to the working principle of the vibration damping roll described in FIG. 3. Additionally the resistance R has to be particularly adjusted here to the impedance of the rolled product. It is well known that an impedance discontinuity acts as a reflector, whereas in case of equality of resistance a maximum of oscillation energy is withdrawn from the oscillation system.

FIGS. 8 to 14 illustrate various embodiments of a vibration damping roll in which the wave guides consist of concentric layers of synthetic plastic material and steel.

Figure 8:
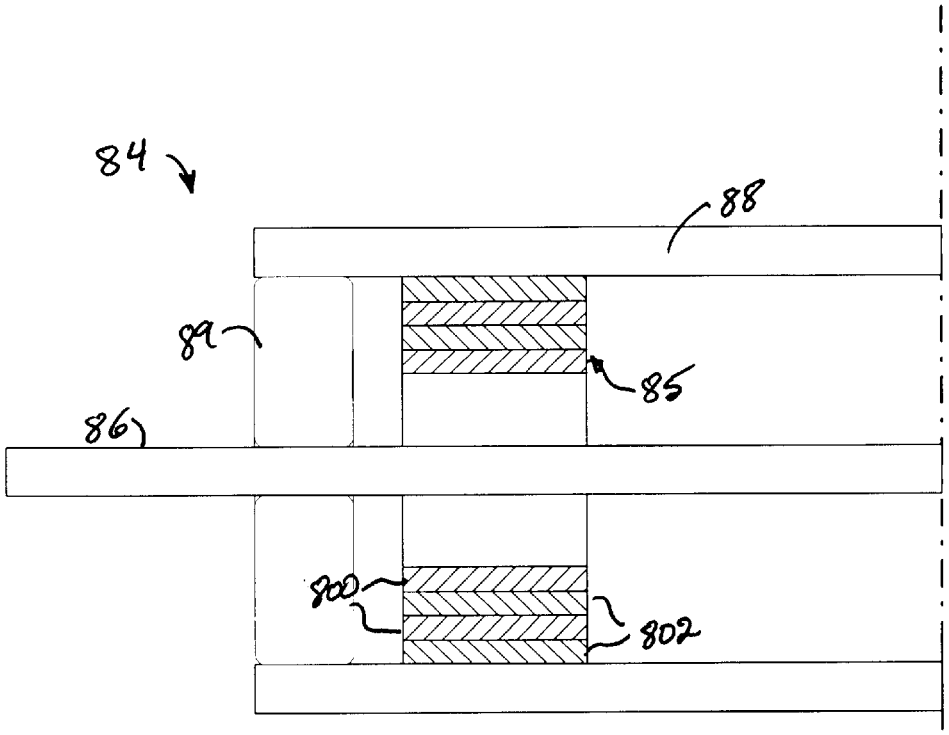
FIGS. 8 to 12 are schematic cross sectional axial views of vibration damping rolls according to the invention showing various locations for wave guides incorporated into the rolls.

In FIG. 8 a vibration damping roll generally indicated by reference numeral 84 comprises a longitudinally extending axle 86 and, an outer shell 88 coupled to the axle 86 by a bearing 89 for rolling contact with a vibrating structure (not shown). A mechanical wave guide 85 is fixed to the interior of the shell 88 and is radially spaced from the axle 86 and is therefore a so-called "one-sided" wave guide.

It will be seen that the wave guide 85 consists of several alternating layers of rigid material and flexible material respectively designated by reference numeral 800, 802.

It will be understood that the nature of the material may be selected according to the intended application. In the case of a rolling mill, it is anticipated that a suitable flexible material might comprise polyurethane or a similar material having high internal damping characteristics. The rigid material would conveniently comprise steel but could also consist of other materials provided the material has a higher density than the material comprising the layer 802.

Figure 9:
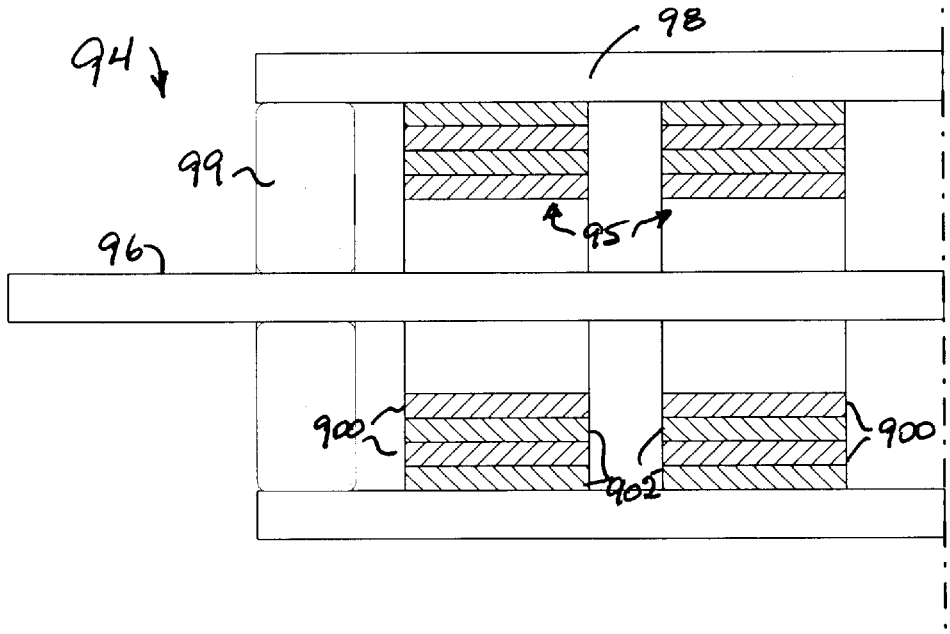

In the embodiment of a vibration damping roll 94 shown in FIG. 9, the roll is characterized by having a plurality of mechanical wave guides 95 longitudinally spaced from each other on the axle 96 and fixed to the outer shell 98 with bearings 99 disposed at opposite ends of the roll. Once more, the mechanical wave guide 95 comprises a layered construction of concentric rings made of rigid and flexible material 900, 902.

It will be appreciated that both FIGS. 8 and 9 show only half of a vibration damping roll on one side of a centre line CL.

Figure 10:
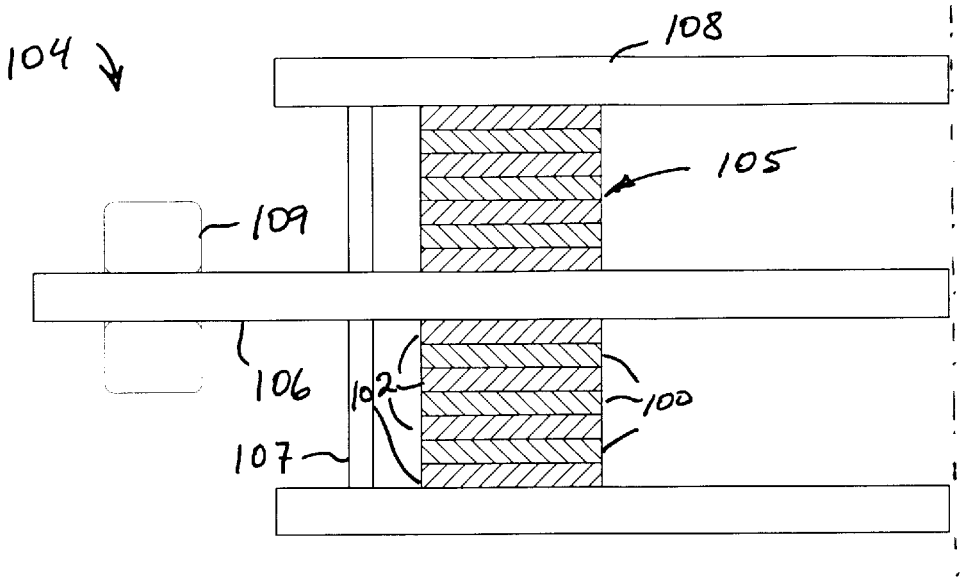

FIG. 10 shows a vibration damping roll 104 comprising an axle 106 rotatably mounted in a bearing 109 with an outer shell 108 coupled to the axle with a hub 107. Here the mechanical wave guide 105 is embodied by a plurality of concentric layers of radially alternating rigid and flexible material 100, 102 and extending between the shell 108 and the axle 106. This is a so called "two-sided" wave guide.

Figure 11:
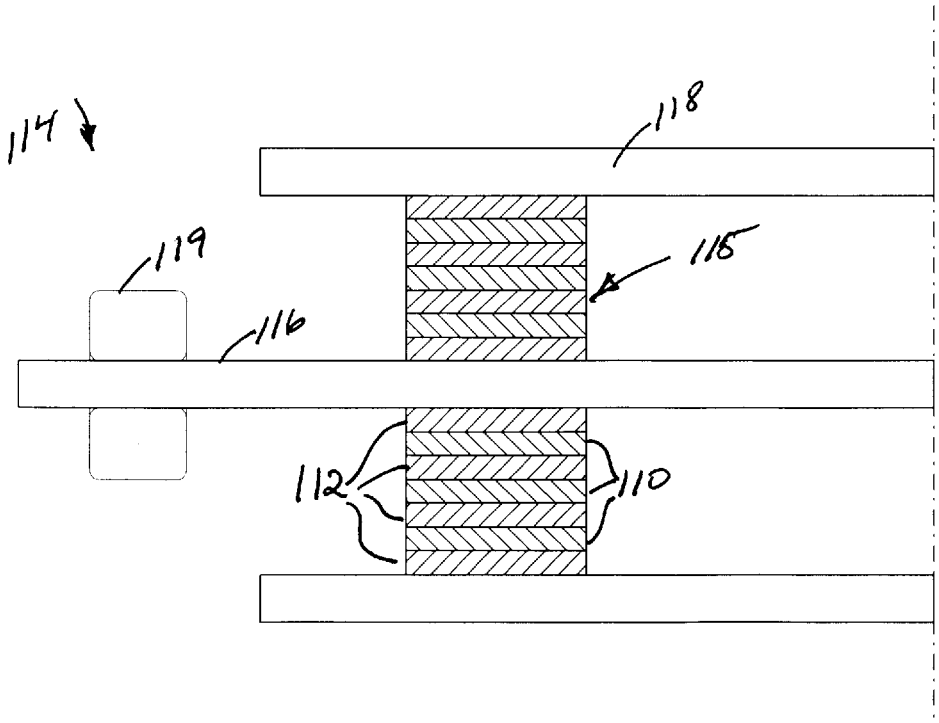

A further embodiment of a vibration damping roll 114 is shown in FIG. 11. The roll is similar in most respects to that of FIG. 10 and includes a rotatable longitudinally extending axle 116, a bearing 119 and a shell 118 which is coupled to the axle 116 by the mechanical wave guide 115 which is fixed between the shell 118 and the axle 116. The wave guide includes a plurality of radially alternating layers of rigid material 110 and flexible material 112 which are concentric with the axle 116. Unlike the embodiment of FIG. 10, the vibration damping roll 114 has no hub.

Figure 12:
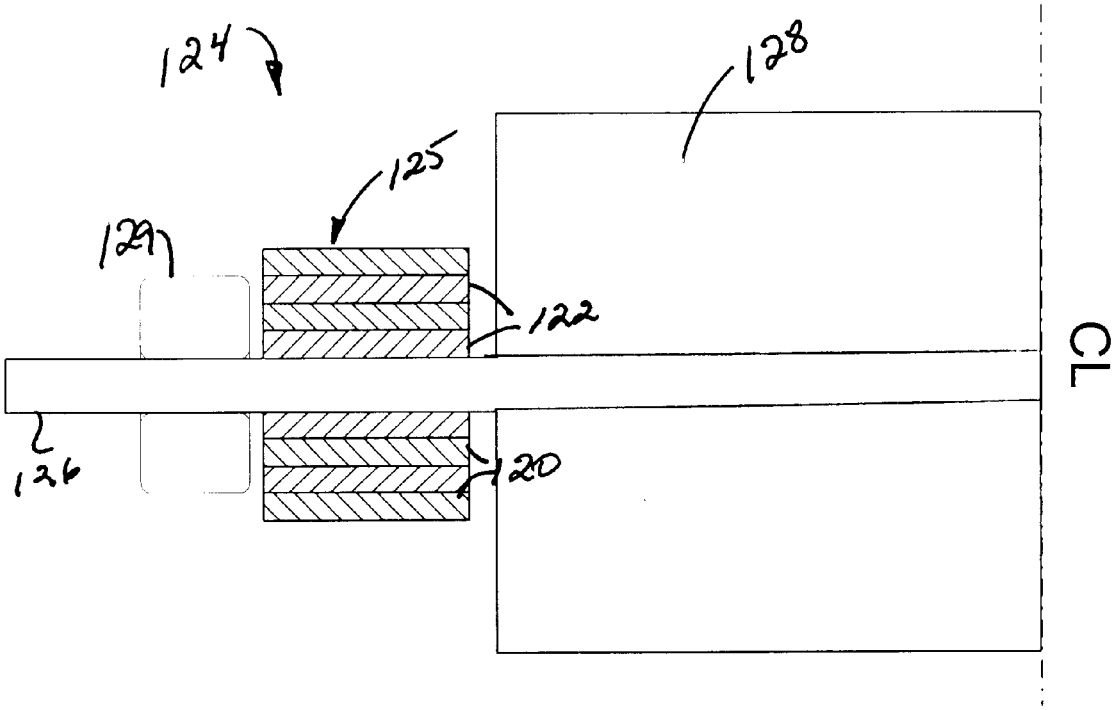
Figure 7:
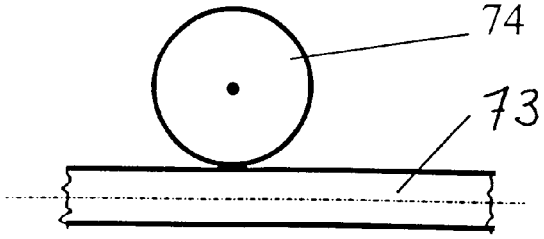
FIG. 7 (drawn adjacent FIG. 12) is a schematic side elevation of a vibration damping roll according to the invention in rolling contact with rolled product.

Still a further embodiment of a vibration damping roll 124 is shown in FIG. 12 in which an axle 126 is coupled to a solid roll in which the shell forms an integral part of the roll body 128. The axle 126 is rotatably mounted to a bearing 129 and a mechanical wave guide 125 is coupled to the axle 126 between the bearing 129 and the roll body 128. The mechanical wave guide 125 consists of alternating concentric layers of rigid material and flexible material 120, 122.

It will be understood that the construction of the wave guide may take many forms. Variations to the layered concentric configuration illustrated in FIGS. 8 to 12 are shown in FIGS. 13 to 16.

Figure 13:
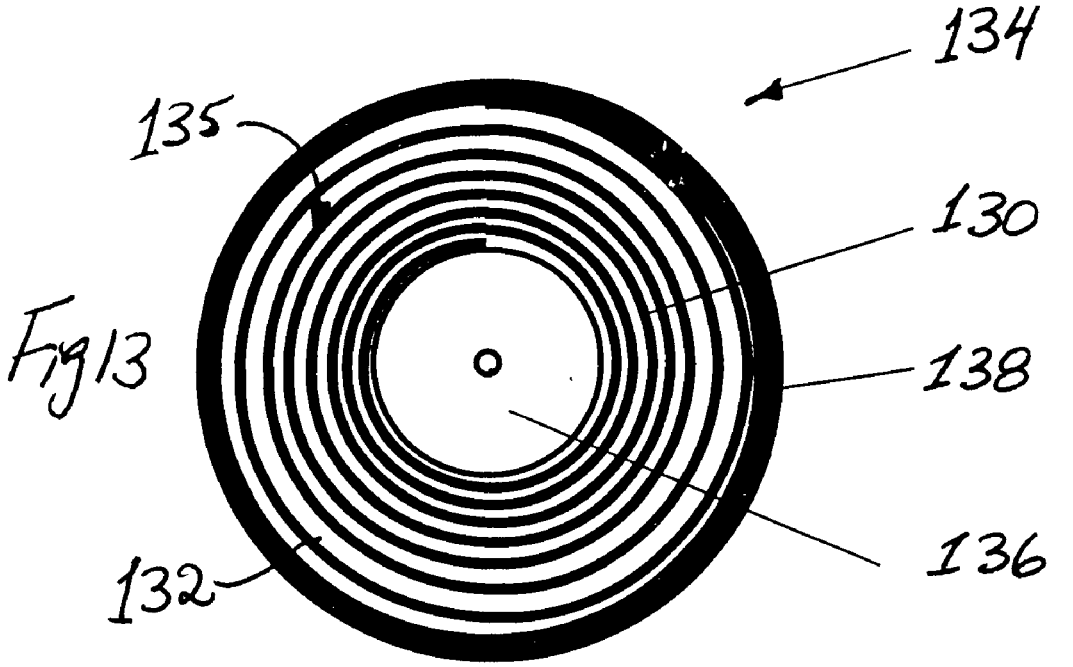
FIGS. 13 to 16 are schematic cross section radial views of vibration damping rolls according to the invention showing a variety of wave-guides incorporated into the rolls.

In FIG. 13, a vibration damping roll is generally indicated by reference numeral 134 and consists of an outer shell 138, an inner core 136 and a mechanical wave guide 135 consisting of a spiral shaped rigid element 130 disposed in a matrix of flexible material 132.

Figure 14:
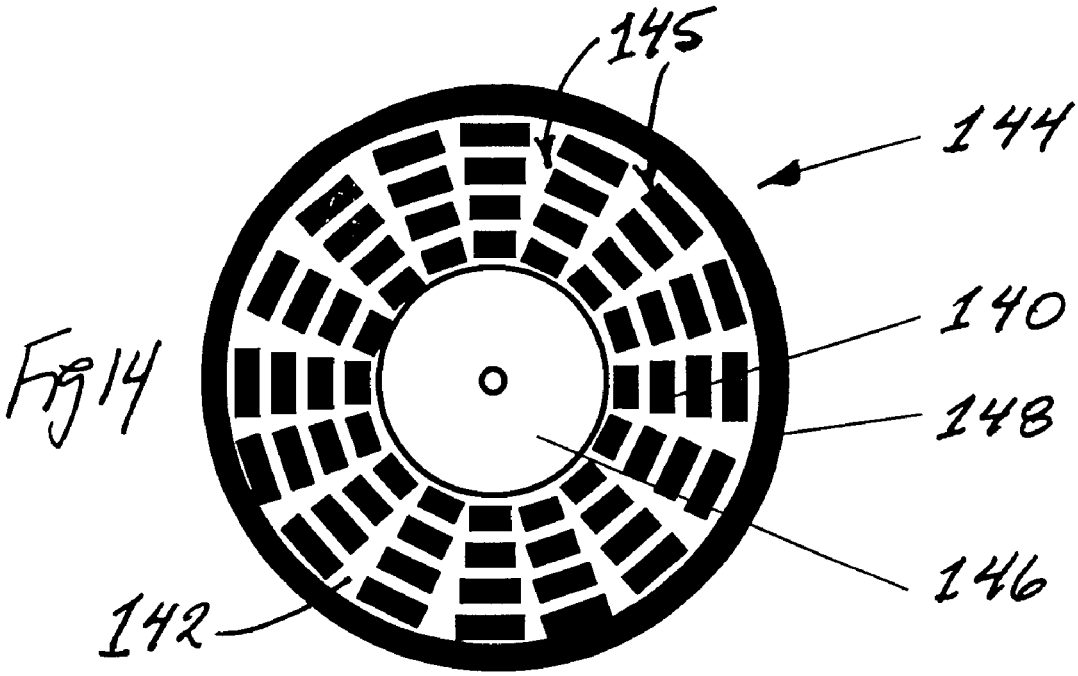

A vibration damping roll 144 shown in FIG. 14 similarly includes an outer shell 148 and inner core 146 and a plurality of wave guides 145 angularly spaced about the core 146, the wave guides 145 which comprising alternating concentric layers of rigid elements 140 disposed in a matrix of flexible material 142. The mass of the radially outer rigid elements is greater than the mass of the radially inner rigid elements. The mass of the elements may therefore be selected according to the desired impedance of the vibration damping roll and the elements may be connected by additional radial or tangential springs for better location within the matrix and for better control of the associated stiffness.

Figure 15:
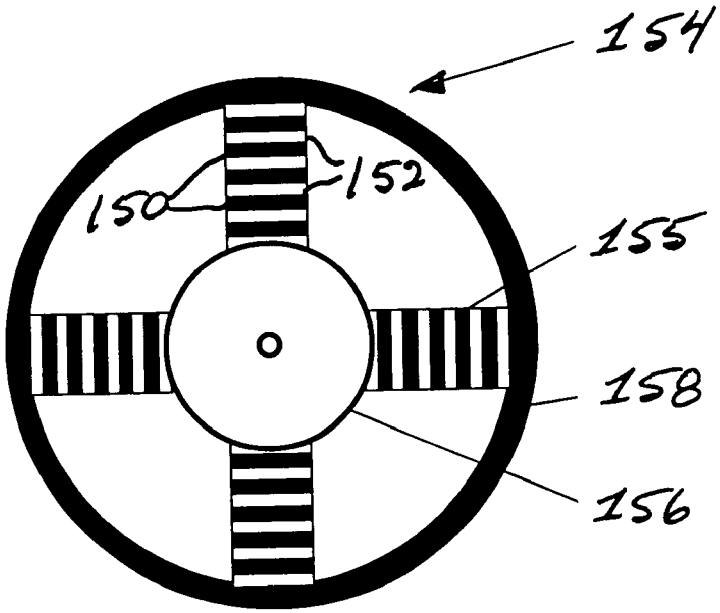

A vibration damping roll 154 shown in FIG. 15 has an outer shell 158 and an inner core 156 between which are mounted four wave guides which are orthogonal with respect to each other about the core 156. The wave guides 155 consist of alternating layers of rigid material 150 and flexible material 152. Conveniently, the vibration damping roll 154 is lightweight in construction since no additional material is required for coupling the outer shell to the inner core between the wave guides 155. If desired, the space between the wave guides may be filled with a fluid for cooling the vibration damping roll. Alternatively, the space may be filled with a homogenous flexible material for lateral support of the wave guides and to increase damping.

Figure 16:
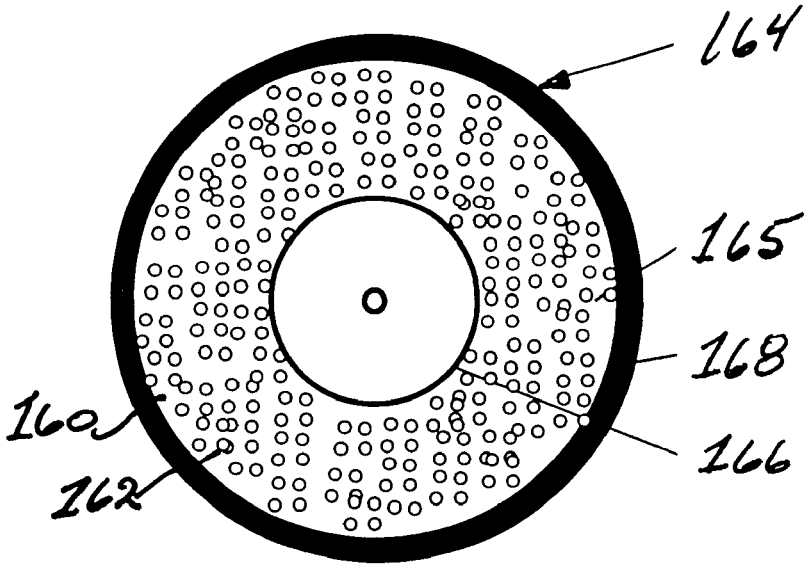

In a final embodiment illustrated in FIG. 16, a vibration damping roll 164 has an outer shell 168 and an inner core 166 and a wave guide 165 comprising a plurality of metal spheres 160 dispersed in matrix 162 of synthetic plastic material. The metal spheres 160 help to increase the average weight of the wave guide 165 and therefore its impedance.

It will be understood that several variations may be made to the above described embodiments of the invention within the scope of the appended claims. As will be understood by those who are skilled in the art, the vibration damping roll in accordance with the invention may be associated with different vibrating structures in accordance with the intended application, the rolling mills described above being included merely for purposes of illustration. The nature and configuration of the wave guides may also be altered and designed to suit the intended application. It will for example be understood that such variations could include a wave guide consisting of an annular ring of rods disposed parallel to a vibration damping roll axis and embedded in a surrounding matrix of flexible material. Such a roll could itself be embodied into an axle assembly or similar structure. Still other variations will be apparent to those skilled in the art.

What is claimed is:

1. A vibration damping roll having an axle assembly disposed on a longitudinal axis of said roll, an outer shell coupled to said axle assembly for rolling contact with a vibrating structure and a mechanical wave guide fixed to at least one of said shell and said axle assembly the wave guide consisting of radially alternating rigid and flexible material having at least two radially disposed rigid elements each disposed adjacent to flexible material, the wave guide being designed to operate over a range of vibration frequencies.

2. A vibration damping roll according to claim 1 in which the outer shell is made of metal.

3. A vibration damping roll according to claim 1 in which the flexible material is made of synthetic plastic.

4. A vibration damping roll according to claim 1 in which said at least one rigid element is made of metal.

5. A vibration damping roll having an axle assembly disposed on a longitudinal axis of said roll, an outer shell coupled to said axle assembly for rolling contact with a vibrating structure and a mechanical wave guide fixed to at least one of said shell and said axle assembly, the wave guide consisting of a plurality of metal spheres dispersed in a matrix of synthetic plastic material, the wave guide being designed to operate over a range of vibration frequencies.

6. A vibration damping roll according to claim 1 in which the wave guide extends along substantially the entire length of the roll.

7. A vibration damping roll according to claim 1 having at least two wave guides longitudinally spaced from each other on said axle assembly.

8. A vibration damping roll according to claim 1 having two wave guides disposed at respective opposite ends of the damping roll.

9. A vibration damping roll according to claim 1 having a plurality of wave guides angularly spaced about said axle assembly.

10. A vibration damping roll according to claim 1 having four wave guides which are orthogonal to each other about said axle assembly.

11. A vibration damping roll having an outer shell for rolling contact with a vibrating structure and a mechanical wave guide fixed to said shell, the wave guide consisting of radially alternating rigid and flexible material having at least two radially disposed rigid elements each disposed adjacent to flexible material, the wave guide being designed to operate over a range of vibration frequencies.

12. A vibration damping roll having an axle assembly disposed on a longitudinal axis of said roll, an outer shell coupled to said axle assembly for rolling contact with a vibrating structure and a mechanical wave guide fixed to said axle assembly, the wave guide consisting of radially alternating rigid and flexible material having at least two radially disposed rigid elements each disposed adjacent to flexible material, the wave guide being designed to operate over a range of vibration frequencies.

13. A vibration damping roll having an axle assembly disposed on a longitudinal axis of said roll, an outer shell coupled to said axle assembly for rolling contact with a vibrating structure and a mechanical wave guide fixed to at least one of said shell and said axle assembly, the wave guide consisting of several radially alternating layers of rigid and flexible material having at least one rigid element disposed adjacent to flexible material, the wave guide being designed to operate over a range of vibration frequencies.

14. A vibration damping roll according to claim 5 in which the alternating layers are concentric with said axle assembly.

15. A vibration damping roll having an axle assembly disposed on a longitudinal axis of said roll, an outer shell coupled to said axle assembly for rolling contact with a vibrating structure and a mechanical wave guide fixed to at least one of said shell and said axle assembly, the wave guide consisting of a spiral shaped rigid element disposed in a matrix of flexible material.

16. A vibration damping roll according to claim 1 in which the wave guide consists of at least two layers of rigid material interspaced with flexible material.

17. A vibration damping roll according to claim 16 km which the mass of radially outer rigid elements is greater than the mass of radially inner rigid elements.

18. A vibration damping roll according to claim 1 in which the rigid elements are selected from a material having a low stiffness to mass ratio.

* * * * *